US009685125B2

(12) United States Patent
Ha et al.

(10) Patent No.: US 9,685,125 B2
(45) Date of Patent: Jun. 20, 2017

(54) APPARATUS AND METHOD OF DRIVING DATA OF LIQUID CRYSTAL DISPLAY DEVICE

(75) Inventors: Sung Chul Ha, Yeosu-si (KR); Chang Hun Cho, Seoul (KR); Jin Cheol Hong, Gumi-si (KR)

(73) Assignee: LG DISPLAY CO., LTD., Seoul (KR)

( * ) Notice: Subject to any disclaimer, the term of this patent is extended or adjusted under 35 U.S.C. 154(b) by 1895 days.

(21) Appl. No.: 11/967,688

(22) Filed: Dec. 31, 2007

(65) Prior Publication Data

US 2009/0058788 A1 Mar. 5, 2009

(30) Foreign Application Priority Data

Aug. 29, 2007 (KR) ..... 10-2007-086988

(51) Int. Cl.
*G09G 3/36* (2006.01)

(52) U.S. Cl.
CPC ... *G09G 3/3611* (2013.01); *G09G 2300/0426* (2013.01); *G09G 2330/06* (2013.01); *G09G 2370/08* (2013.01)

(58) Field of Classification Search
CPC ..... G09G 3/3611; G09G 2370/08; G09G 2300/0426; G09G 2330/06
USPC ..... 345/87, 93–95, 98–100, 103, 211–213
See application file for complete search history.

(56) References Cited

U.S. PATENT DOCUMENTS 3,576,496 A * 4/1971 Garagnon ..... 327/265
6,225,992 B1 * 5/2001 Hsu et al. ..... 345/211
6,407,729 B1 6/2002 Moon
7,002,544 B2 * 2/2006 Sekido ..... 345/98
7,164,405 B1 * 1/2007 Jeong et al. ..... 345/94
7,880,693 B2 * 2/2011 Minami ..... 345/76
8,587,739 B2 * 11/2013 Yamashita et al. ..... 349/39
2002/0118152 A1 * 8/2002 Nukiyama et al. ..... 345/87
2003/0001808 A1 * 1/2003 Sakuma et al. ..... 345/87
2003/0098833 A1 * 5/2003 Sekido et al. ..... 345/87
(Continued)

FOREIGN PATENT DOCUMENTS

CN 1506720 6/2004
JP 2003-233358 A 8/2008
(Continued)

OTHER PUBLICATIONS

Office Action issued in corresponding Korean Patent Application No. 10-2007-0086988; issued Jul. 16, 2008.
(Continued)

*Primary Examiner* — Jonathan Horner
(74) *Attorney, Agent, or Firm* — Brinks Gilson & Lione

(57) ABSTRACT

An apparatus and method of driving data of a liquid crystal display device is disclosed, which can minimize an electromagnetic interference EMI noise by decreasing an output peak current of a data driver, the apparatus comprising a timing controller for supplying a reference source output enable signal; a delay circuit for delaying the reference source output enable signal and supplying a plurality of source output enable signals provided with the different delay times; and a data driver, including a plurality of data ICs to divide and drive data lines of a liquid crystal panel into a plurality of data blocks, for dispersing data output timing of the plurality of data ICs in response to the plurality of source output enable signals.

26 Claims, 8 Drawing Sheets

(56) References Cited

U.S. PATENT DOCUMENTS

| | | | | |
|---|---|---|---|---|
| 2004/0257321 | A1* | 12/2004 | Baek et al. | 345/87 |
| 2005/0264548 | A1* | 12/2005 | Okamura et al. | 345/204 |
| 2006/0193002 | A1* | 8/2006 | Satou et al. | 358/1.15 |
| 2006/0290859 | A1* | 12/2006 | Ko et al. | 349/139 |
| 2007/0080433 | A1* | 4/2007 | Lai | 257/666 |
| 2007/0152947 | A1* | 7/2007 | Tanaka et al. | 345/100 |
| 2010/0194731 | A1* | 8/2010 | Hiratsuka | 345/211 |

FOREIGN PATENT DOCUMENTS

| | | | |
|---|---|---|---|
| KR | 2000-003396 | * | 1/2000 |
| KR | 2000-0022627 | * | 4/2000 |
| KR | 10 2000-056478 | A | 9/2000 |
| KR | 10 2002-0007578 | A | 1/2002 |

OTHER PUBLICATIONS

Office Action issued in corresponding Chinese Patent Application No. 200710160013.5; issued May 17, 2010.
Office Action issued in corresponding Chinese Patent Application No. 200710160013.5, mailed Mar. 31, 2011.
Office Action issued in corresponding Chinese Patent Application No. 200710160013.5, mailed Aug. 24, 2011.

* cited by examiner

APPARATUS AND METHOD OF DRIVING DATA OF LIQUID CRYSTAL DISPLAY DEVICE

CLAIM FOR PRIORITY

This application claims the benefit of Korean Patent Application No. 2007-86988 filed Aug. 29, 2007, which is hereby incorporated by reference as if fully set forth herein.

BACKGROUND OF THE INVENTION

1. Field of the Invention

The present invention relates to a liquid crystal display device, and more particularly, to an apparatus and method of driving data of a liquid crystal display device which can minimize an electromagnetic interference EMI noise by decreasing an output peak current of a data driver.

2. Discussion of the Related Art

Generally, a liquid crystal display device displays images by using the electric and optical properties of liquid crystal. The liquid crystal has the anisotropic property, whereby the liquid crystal is provided with refractive and dielectric indexes changed in long and short axes of liquid crystal molecules. In this respect, alignment of the liquid crystal molecules and the optical property of liquid crystal can be easily controlled. Accordingly, the liquid crystal display device is provided with the alignment direction of liquid crystal molecules being varied based on an electric field applied thereto, so that the liquid crystal display device displays images by controlling the light transmittance.

The liquid crystal display device is comprised of a liquid crystal panel including a plurality of pixels arranged in a matrix configuration; a gate driver for driving gate lines on the liquid crystal panel; and a data driver for driving data lines on the liquid crystal panel.

Each of pixels included in the liquid crystal panel represents a desired color by combining red, green and blue sub-pixels which control the light transmittance according to a data signal. Each of the sub-pixels includes a thin film transistor connected to the gate and data lines; and a liquid crystal capacitor connected to the thin film transistor. In this case, the liquid crystal capacitor charges a differential voltage between the data signal supplied to a pixel electrode through the thin film transistor and a common voltage supplied to a common electrode, and drives the liquid crystal according to the charged differential voltage, to thereby control the light transmittance.

The gate driver drives the gate lines on the Liquid crystal panel in sequence.

Whenever the gate lines are driven respectively, the data driver converts a digital data signal to an analog data signal, and supplies the analog data signal to the data lines on the liquid crystal panel. At this time, as shown in FIG. 1, the data driver simultaneously outputs the data signals Vout corresponding to one horizontal line in response to a source output enable SOE signal. According as the data signals Vout are outputted at the same time, a peak current is generated in that an output current Iout is rapidly raised at an output timing of the data driver.

Due to the high peak current of the data driver, the related art liquid crystal display device has a problem of electromagnetic interference EMI noise. With the increase in size of the liquid crystal display device, an output channel and load of the data driver are increased so that the peak current of data driver is also increased. Accordingly, the EMI noise of broad band BB type is further increased as shown in FIG. 2. Also, the high peak current of data driver causes the increase of power consumption and also causes undesirable effects on the liquid crystal panel, that is, a malfunction of gate line and gate driver.

SUMMARY

A data driving apparatus of liquid crystal display device comprises a timing controller for supplying a reference source output enable signal; a delay circuit for delaying the reference source output enable signal and supplying a plurality of source output enable signals provided with the different delay times; and a data driver, including a plurality of data ICs to divide and drive data lines of a liquid crystal panel into a plurality of data blocks, for dispersing data output timing of the plurality of data ICs in response to the plurality of source output enable signals.

The delay circuit includes a plurality of RC delaying parts connected to a supply line of the reference source output enable signal in series. Also, the plurality of RC delaying parts are provided with time constants set with the same value. The delay time of rising and falling times in the plurality of source output enable signals is increased in proportion to the number of RC delaying parts through which the reference source output enable signal passes, and is determined based on the total of time constants of the RC delaying parts through which the reference source output enable signal passes. The plurality of data ICs are supplied with the plurality of output enable signals in a sequential order where the delay time is increased gradually as becoming more distant from the timing controller.

Alternatively, the delay circuit includes a plurality of RC delaying parts connected to a supply line of the reference source output enable signal in parallel and provided with different time constants.

In another aspect of the present disclosure, a data driving apparatus of liquid crystal display device comprises a timing controller for generating a reference source output enable signal and supplying the generated reference source output enable signal to first and second signal lines; a first data driver, including a plurality of data ICs, for division-driving data lines included in a first region of a liquid crystal panel; a second data driver, including a plurality of data ICs, for division-driving data lines included in a second region of the liquid crystal panel; a first PCB substrate connected between the timing controller and the first data driver; a second PCB substrate connected between the timing controller and the second data driver; a first delay circuit, mounted on the first PCB substrate, for dispersing data output timing of the first data driver by delaying the reference source output enable signal supplied from the first signal line; and a second delay circuit, mounted on the second PCB substrate, for dispersing data output timing of the second data driver by delaying the reference source output enable signal supplied from the second signal line.

In another aspect of the present disclosure, a data driving method of liquid crystal display device comprises generating a reference source output enable signal; generating a plurality of source output enable signals whose delay time of rising and falling times is set differently, by delaying the reference source output enable signal; and dispersing the data output timing output from a plurality of data lines in response to the plurality of source output enable signals.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Hereinafter, an apparatus and method of driving data of a liquid crystal display device according to the present disclosure will be described with reference to the accompanying drawings.

Figure 3:
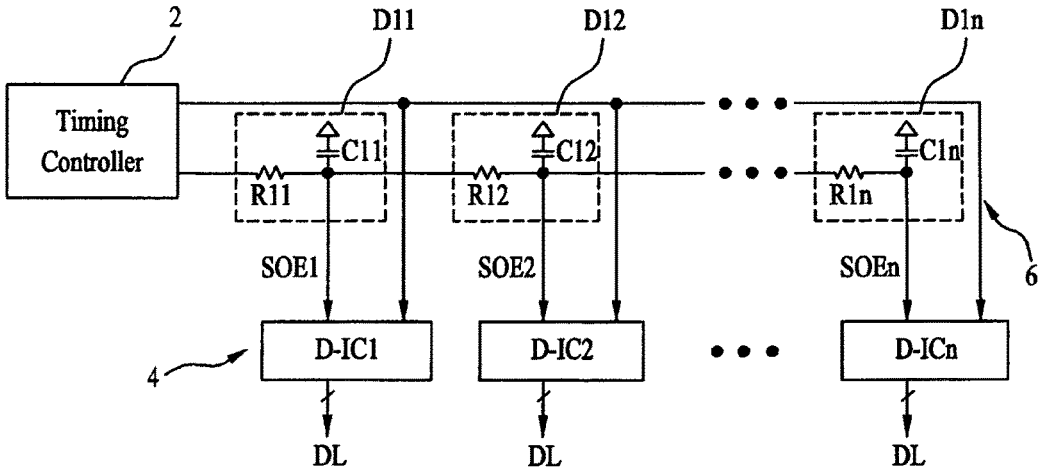
FIG. 3 is a block diagram schematically illustrating a data driving apparatus of a liquid crystal display device according to the first embodiment of the present disclosure.

FIG. 3 is a block diagram schematically illustrating a data driving apparatus of a liquid crystal display device according to the first embodiment of the present disclosure.

Figure 4:
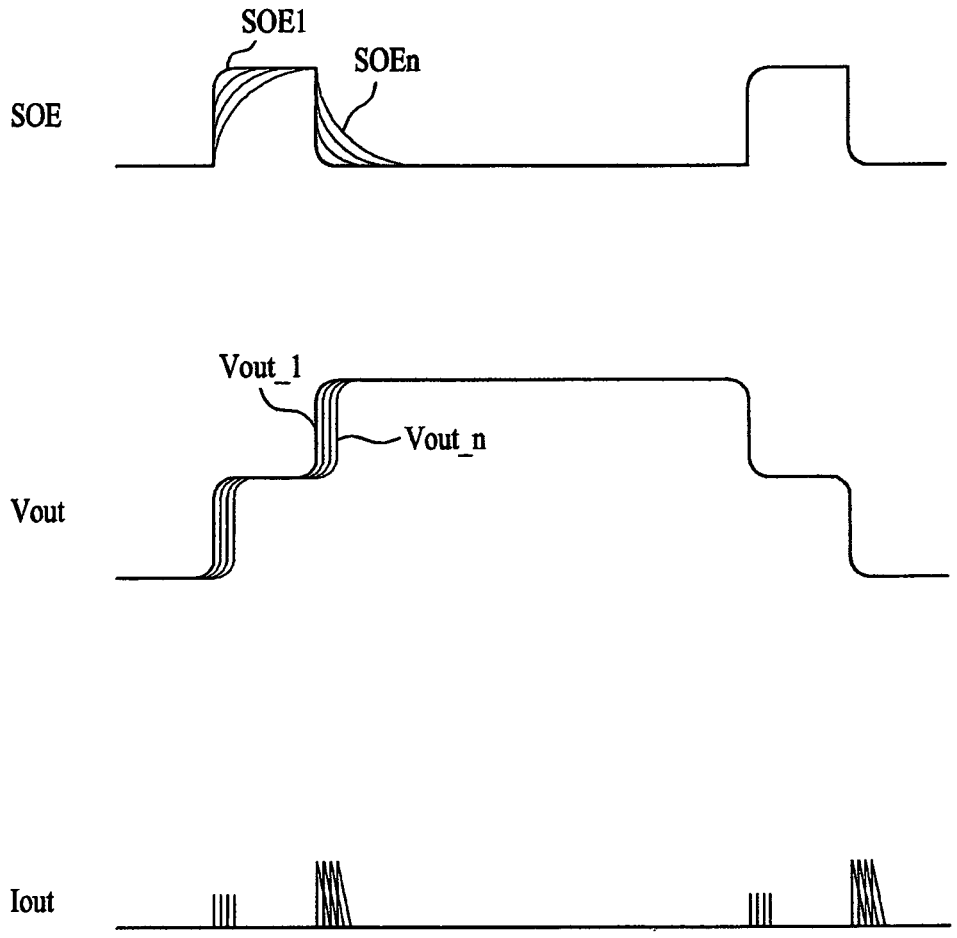
FIG. 4 is a driving waveform diagram of a data driving apparatus shown in FIG. 3.

FIG. 4 is a driving waveform diagram of a data driving apparatus shown in FIG. 3.

As shown in FIG. 3, the data driving apparatus of liquid crystal display device is comprised of a timing controller 2 for supplying video data and control signals including SOE signals; a data driver 4 including a plurality of data integrated circuits (hereinafter, referred to as "IC") D-IC1~D-ICn to drive data lines DL of a liquid crystal panel under control of the timing controller 2; and a delay circuit 6 for delaying the SOE signal supplied from the timing controller 2 with different delay time periods, and supplying the SOE signal delayed with the different delay time periods to the plurality of data ICs D-IC1~D-ICn, respectively. FIG. 4 illustrates an output voltage Vout and an output current Iout in the data driver 4 of FIG. 3, the SOE signal output from the timing controller 2, and SOE1 to SOEn respectively supplied to the plurality of data ICs with the different delay time periods.

The timing controller 2 aligns the video data provided from the external, and supplies the aligned video data to the data driver 4. Also, the timing controller 2 generates and supplies a plurality of data control signals to control the data driver 4 by using synchronized signals provided from the external, for example, a data enable signal to notify an effective block of data, and a dot clock to determine a transmission frequency of data. The timing controller 2 may additionally use horizontally and vertically synchronized signals provided from the external. The plurality of data control signals include the SOE signal to control a data output period of the data driver 4, a source start pulse to command a start of sampling data, a source shift clock to control a sampling timing of data, and a polarity control signal to control a voltage polarity of data.

The plurality of data ICs D-IC1~D-ICn of the data driver 4 generate sequential sampling signals by shifting the source start pulse supplied from the timing controller 2 for one horizontal period according to the source shift clock, and sequentially latch the data supplied from the timing controller 2 in response to the generated sampling signal. The plurality of data ICs D-IC1~D-ICn convert the data into an analog data signal by parallel-latching the data for one horizontal line sequentially latched for one horizontal period at a rising time of the SOE signal during a next horizontal period, and output the analog data signal to the data lines DL of liquid crystal panel at a falling time of the SOE signal. To decrease a peak of output current by the data output of data driver 4, the data lines DL are divided into a plurality of data blocks, and the respective data blocks are provided with the different output timings of data to disperse the data output and the peak of output current.

For example, the delay time, that is, the falling time (rising time) of SOE1 to SOEn signals respectively supplied to the plurality of data ICs D-IC1~D-ICn to drive the data lines DL by a division-driving method, is set differently, as shown in FIG. 4. Accordingly, the output timing of data voltages Vout_1~Vout_N output from the plurality of data ICs D-IC1~D-ICn is dispersed so that the peak current of the data driver 4 is dispersed and decreased.

For this, the delay circuit 6 of the present disclosure includes a plurality of delaying parts D11~D1n, which are connected with an SOE signal line for supplying the SOE signal from the timing controller 2 in series, for dividing the SOE signal into the plurality of SOE signals SOE1 to SOEn provided with the different delay times and supplying the plurality of SOE signals provided with the different delay times.

For example, the plurality of delaying parts D11~D1n use RC circuits, respectively. The plurality of delaying parts D11~D1n connected in series are provided with time constants R11C11~R1nC1n which are set as the same value or the different values. If the time constants are differently set in the respective delaying parts D11~D1n, each of the respective delaying parts D11~D1n is provided with R and C components, wherein R and C components may be set differently in the respective delaying parts D11~D1n, or any one of the R and C components in the respective delaying parts may be set as the same value, and the other of the R and C components in the respective delaying parts may be set as the different values. According as the plurality of delaying parts D11~D1n are connected in series, the delay time of the SOE signals SOE1 to SOEn respectively supplied to the plurality of data ICs D-IC1~D-ICn is increased in proportion to the number of delaying parts D through which the SOE signal passes. In other words, the delay time of the SOE signals SOE1 to SOEn is determined based on the total of time constants in the delaying parts D through which the SOE signal passes.

In detail, the delay time of SOE1 signal, supplied to the first data IC D-IC1 by the first delaying part D11 having the shortest transmission distance of SOE signal from the timing controller 2, is determined as the first time constant R11C11 of the first delaying part D11, which is shortest as shown in FIG. 4. Then, the delay time of SOE2 signal supplied to the second data IC D-IC2 by the first and second delaying parts D11 and D12 is determined as the total of the first and second time constants of the first and second delaying parts D11 and D12, whereby the delay time of SOE2 signal is longer than that of SOE1 signal as shown in FIG. 4. Then, the delay time of SOEn signal supplied to the 'n'th data IC D-ICn by the 'n'th delaying part D1n having the longest transmission distance of SOE signal from the timing controller 2 is determined as the total of first to 'n'th time constants R11C11+R12C12+ . . . +R1nC1n of the first to 'n'th delaying parts D11~D1n, which is longest as shown in FIG. 4.

In response to the respective falling times of the SOE1 to SOEn signals provided with the different delay times, the output timing of data voltages Vout_1~Vout_n of data ICs D-IC1~D-ICn is differently dispersed as shown in FIG. 4, whereby the peak of output current Iout is dispersed and decreased. As a result, it is possible to decrease EMI noise and power consumption and to prevent malfunctioning of the liquid crystal panel.

Preferably, the delay time (time constant) of SOE1 to SOEn signals is determined within a range sufficient for obtaining the data-charging time of data lines DL, for example, a range between 0 ns and 500 ns, so as not to generate deviation in data-charging amount by the difference of output timings among the data voltages Vout_1~Vout_n output from the plurality of data ICs D-IC 1~D-ICn. Also, it is preferable to maintain the uniform difference in delay time among the SOE signals SOE1 to SOEn. However, the difference of delay time between the adjacent SOE signals may be set differently.

The delay circuit 6 may be mounted on a printed circuit board (hereinafter, referred to as a "PCB", not shown) to relay the timing controller 2 and the data driver 4, or may be formed in each of the data ICs D-IC1~D-ICn or each of circuit films (not shown) on which the plurality of data ICs D-IC1~D-ICn are mounted respectively. Also, when the delay circuit 6 may be provided with resistors R11~R1n and capacitors C11~C1n separated from each other, the resistors R11~R1n are mounted on the PCB and the capacitors C11~C1n are respectively formed in the plurality of data ICs D-IC1~D-ICn.

Figure 5:
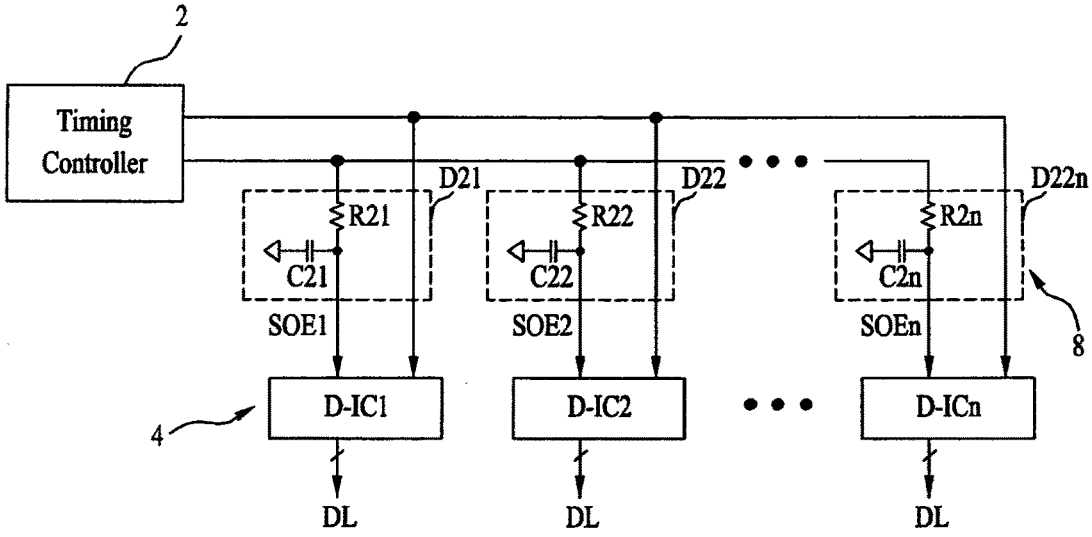
FIG. 5 is a block diagram schematically illustrating a data driving apparatus of a liquid crystal display device according to the second embodiment of the present disclosure.

FIG. 5 is a block diagram schematically illustrating a data driving apparatus of a liquid crystal display device according to the second embodiment of the present disclosure. The data driving apparatus of FIG. 5 is identical in structure to the data driving apparatus of FIG. 3 except that a delay circuit 8 is comprised of a plurality of delaying parts D21~D2n connected to an SOE signal line in parallel, whereby the detailed explanation for the same parts will be omitted.

The delay circuit 8 shown in FIG. 5 includes the plurality of delaying parts D21~D2n connected to the main SOE signal line in parallel, wherein the plurality of delaying parts D21~D2n are provided with time constants R21C21~R2nC2n set differently. If the time constants are differently set in the respective delaying parts D21~D2n, each of the respective delaying parts D21~D2n is provided with R and C components, wherein R and C components may be set differently in the respective delaying parts D21~D2n, or any one of the R and C components in the respective delaying parts may be set as the same value, and the other of the R and C components in the respective delaying parts may be set as the different values.

Also, it is preferable to set the uniform difference of time constant between the adjacent delaying parts D21~D2n. That is, the difference in time constant between the first and second delaying parts D21 and D22 is identical to the different in time constant between the second and third delaying parts D22 and D23. However, the difference of time constant between the adjacent delaying parts may be set differently among the delaying parts D21~D2n. In this case, the time constants R21C21~R2nC2n of the delaying parts D21~D2n are randomly increased or decreased in value. Preferably, the time constants R21C21~R2nC2n of the delaying parts D21~D2n are successively increased or decreased in value, to thereby minimize the deviation in data output timing between the adjacent data ICs.

For example, the first delaying part D21 supplies the SOE1 signal, whose rising and falling times are delayed by the first time constant R21C21, to the first data IC D-IC1. Also, the second delaying part D22 supplies the SOE2 signal, whose rising and falling times are delayed by the second time constant R22C22 being larger than the first time constant R21C21, to the second data IC D-IC2. The 'n'th delaying part D2n supplies the SOEn signal, delayed by the 'n'th time constant R2nC2n which is largest among the plurality of time constants, to the 'n'th data IC D-ICn.

In response to the respective falling times of the SOE1 to SOEn signals provided with the different delay times, the output timing of data voltages Vout_1~Vout_n of data ICs D-IC1~D-ICn is differently dispersed as shown in FIG. 4, whereby the peak of output current Iout is dispersed and decreased. As a result, it is possible to decrease EMI noise and power consumption and to prevent misoperation of liquid crystal panel.

The delay circuit 8 may be mounted on a PCB to relay the timing controller 2 and the data driver 4, or may be formed in each of the data ICs D-IC1~D-ICn or each of circuit films (not shown) on which the plurality of data ICs D-IC1~D-ICn are mounted respectively. Also, when the delay circuit 8 may be provided with resistors R21~R2n and capacitors C21~C2n separated from each other, the resistors R21~R2n are mounted on the PCB and the capacitors C21~C2n are respectively formed in the plurality of data ICs D-IC1~D-ICn.

Figure 6:
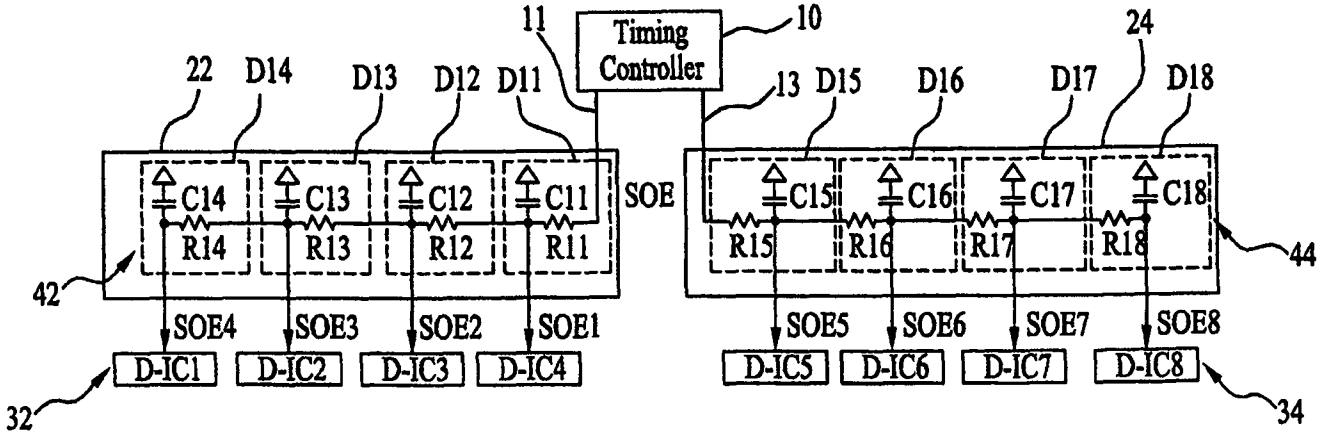
FIG. 6 is a block diagram schematically illustrating a data driving apparatus of a liquid crystal display device according to the third embodiment of the present disclosure.

FIG. 6 is a block diagram schematically illustrating a data driving apparatus of a liquid crystal display device according to the third embodiment of the present disclosure.

The data driving apparatus shown in FIG. 6 is comprised of a timing controller 10 which supplies SOE signals; a first data driver 32 which includes a plurality of data ICs D-IC1~D-IC4 connected through the timing controller 10 and a first PCB 22; a second data driver 34 which includes a plurality of data ICs D-IC5~D-IC8 connected through the timing controller 10 and a second PCB 24; a first delay circuit 42 which is formed in the first PCB 22, wherein the first delay circuit 42 divides an SOE signal output from the timing controller 10 into SOE1 to SOE4 signals provided with the different delay times, and supplies the SOE1 to SOE4 signals to the data ICs D-IC1~D-IC4; and a second delay circuit 44 which is formed in the second PCB 24, wherein the second delay circuit 44 divides the SOE signal output from the timing controller 10 into SOE5 to SOE8 signals provided with the different delay times, and supplies the SOE5 to SOE8 signals to the data ICs D-IC5~D-IC8.

FIG. 6 shows only SOE signal lines 11 and 13 except the other SOE signal lines, wherein the SOE signal lines 11 and 13 are respectively connected between the timing controller 10 and the first data driver 32 and between the timing controller 10 and the second data driver 34.

The timing controller 10 aligns data provided from the external, divides the aligned data into first data to be supplied to the first data driver 32 and second data to be supplied to the second driver 34, and outputs the first data and the second data. Also, the timing controller 10 respectively supplies first and second data control signals including the SOE signal to the first and second data drivers 32 and 34, wherein the first data control signal is identical to the second data control signal.

The first PCB 22 supplies the first data and first data control signal output from the timing controller 10 to the first data driver 32, and the second PCB 24 supplies the second data and second data control signal output from the timing controller 10 to the second data driver 34.

The first delay circuit 42 includes a plurality of delaying parts D11~D14 mounted on the first PCB 22 and connected to the first SOE signal line 11 in series. The second delay circuit 44 includes a plurality of delaying parts D15~D18 using a RC circuit mounted on the second PCB 24 and connected to the second SOE signal line 13 in series.

Unlike the above description, the delaying parts D11~D14 included in the first delay circuit 42 may be respectively formed in the plurality of data ICs D-IC4~D-IC1. In another way, after resistors R11~R14 may be separated from capacitors C11~C14, the resistors R11~R14 may be mounted on the first PCB 22, and the capacitors C11~C14 may be respectively formed in the plurality of data ICs D-IC4~D-IC1. Also, the delaying parts D15~D18 of the second delay circuit 44 may be respectively formed in the plurality of data ICs D-IC5~D-IC8. In another way, after resistors R15~R18 may be separated from capacitors C15~C18, the resistors R15~R18 may be mounted on the second PCB 24, and the capacitors C15~C18 may be respectively formed in the plurality of data ICs D-IC5~D-IC8.

The delaying parts D11~D14 included in the first delay circuit 42 have the respective time constants R11C11~R14C14 which are set as the same value or the different values. Also, the delaying parts D15~D18 included in the second delay circuit 44 have the respective time constants R15C15~R18C18 which are set as the same value or the different values. The respective time constants R11C11~R14C14 of delaying parts D11~D14 included in the first delay circuit 42 may be symmetric or asymmetric to the respective time constants R15C15~R18C18 of delaying parts D15~D18 included in the second delay circuit 44.

According as the transmission distance of SOE signal from the timing controller 10 is increased by the first delay circuit 42, that is, the number of delaying parts D through which SOE signal passes is increased, the delay time of SOE signal is increased.

In detail, the SOE1 signal delayed by the first time constant R11C11 of the first delaying part D11 included in the first delay circuit 42 is supplied to the fourth data IC D-IC4 having the shortest distance from the timing controller 10 among the data ICs D-IC1~D-IC4 of the first data driver 32. The SOE2 signal delayed by the total of time constants R11C11+R12C12 of first and second delaying parts D11 and D12 is supplied to the third data IC D-IC3. The SOE4 signal delayed by the total of time constants R11C11+R12C12+ . . . +R14C14 of first to fourth delaying parts D11 to D14 is supplied to the first data IC D-IC1 having the longest distance from the timing controller 10 among the data ICs D-IC1~D-IC4 of the first data driver 32.

In the same method as the first data driver 32, the SOE5 to SOE8 signals sequentially delayed in proportion to the number of delaying parts D through which SOE signal from the timing controller passes are respectively supplied to the fifth to eighth data ICs D-IC5~D-IC8 of the second data driver 34 by the second delay circuit 44. The delay time of SOE1 to SOE4 signals output from the first delay circuit 42 may be symmetric or asymmetric to the delay time of SOE5 to SOE8 signals output from the second delay circuit 44.

The data ICs D-IC1~D-IC4 of the first data driver 32 respectively output the data at the different output timings in response to the respective falling times of SOE4 to SOE1 signals. Also, the data ICs D-IC5~D-IC8 of the second data driver 34 respectively output the data at the different output timings in response to the respective falling times of SOE5 to SOE8 signals. The data output timing of data ICs D-IC1~D-IC4 of the first data driver 32 may be symmetric or asymmetric to the data output timing of data ICs D-IC5~D-IC8 of the second data driver 34, wherein the data output timing of data ICs may be provided in an alternate order or a sequential order. As a result, the data output timing of first and second data drivers 32 and 34 is dispersed so that the peak of output current is dispersed and decreased. Accordingly, it is possible to decrease EMI noise and power consumption and to prevent malfunctioning of the liquid crystal panel.

Figure 7:
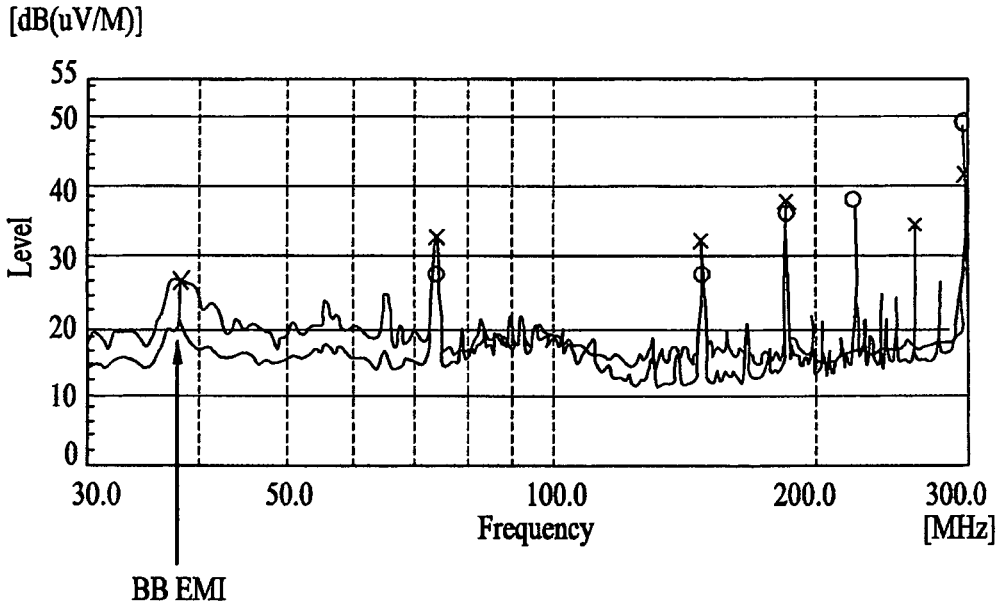
FIG. 7 is an EMI noise waveform diagram of a liquid crystal display device shown in FIG. 6.

FIG. 7 is an EMI noise waveform diagram of a liquid crystal display device using a serial delay circuit shown in FIG. 6.

Figure 1:
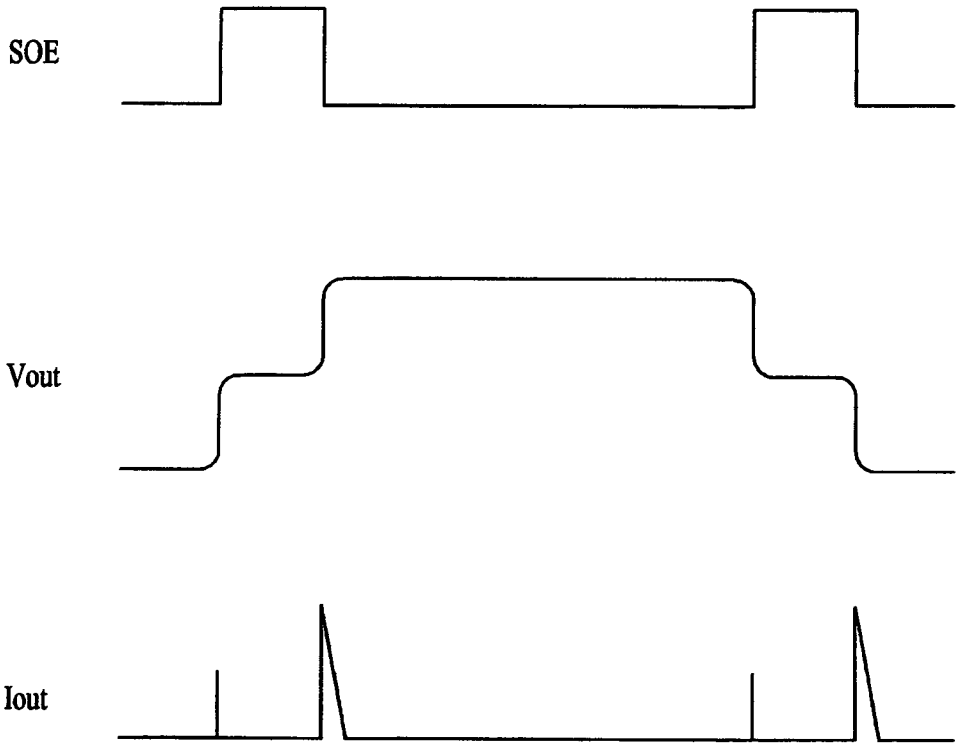
FIG. 1 Related Art
FIG. 1 is a data driving waveform diagram of a liquid crystal display device according to the related art.
Figure 2:
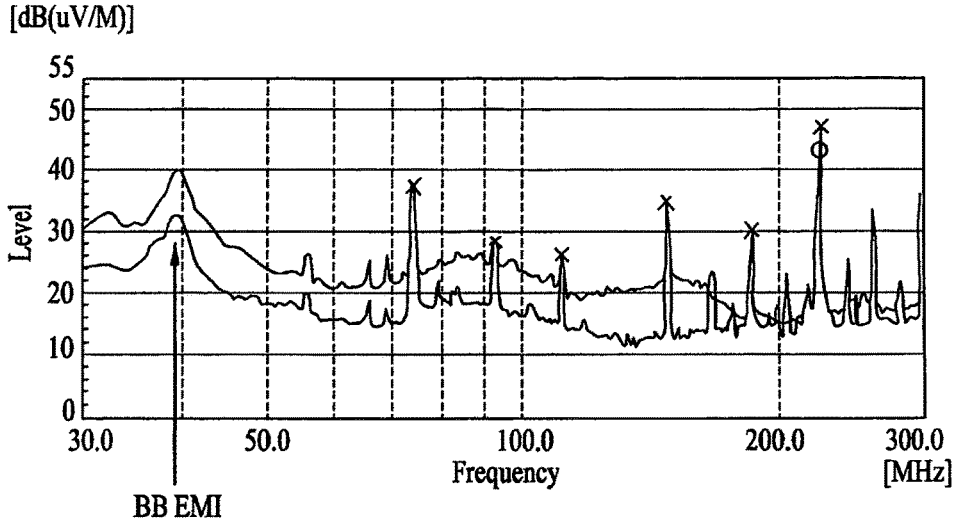
FIG. 2 Related Art
FIG. 2 is an EMI noise waveform diagram of a liquid crystal display device according to the related art.

Referring to FIG. 2, in case of the related art, a broad band type EMI noise is detected above the level of 30 dB corresponding to a reference value of EMI standard in a range between 30 MHz and 100 MHz. However, in case of the present disclosure, as shown in FIG. 7, the broad band type EMI noise is detected below the level of 30 dB in the range between 30 MHz and 100 MHz, owing to the distribution of data output timing.

Figure 8:
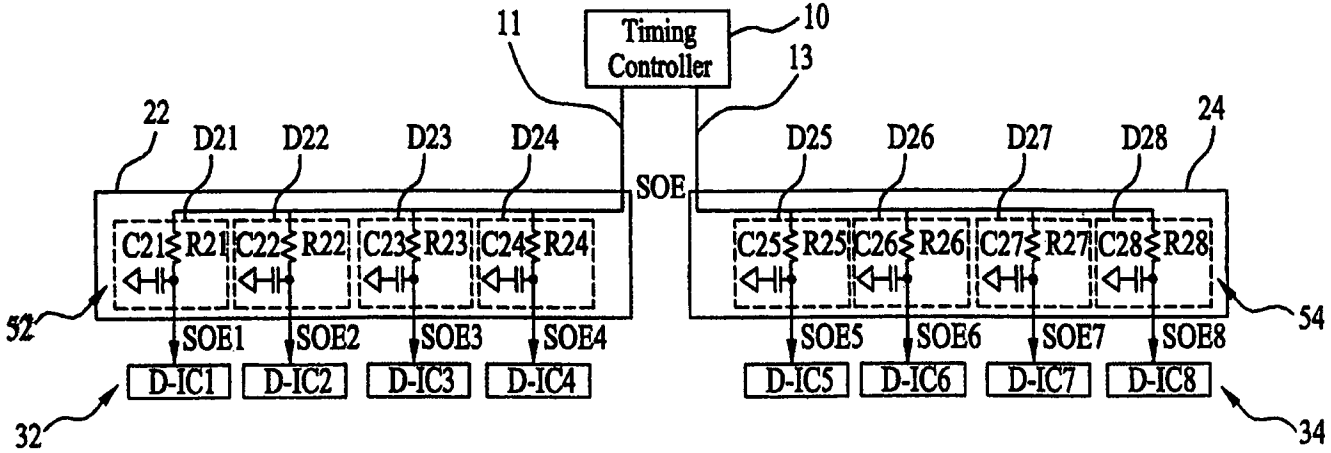
FIG. 8 is a block diagram schematically illustrating a data driving apparatus of a liquid crystal display device according to the fourth embodiment of the present disclosure.

FIG. 8 is a block diagram schematically illustrating a data driving apparatus of a liquid crystal display device according to the fourth embodiment of the present disclosure. The data driving apparatus of FIG. 8 is identical in structure to the data driving apparatus of FIG. 6 except that a first delay circuit 52 includes a plurality of delaying parts D21~D24 connected to a first SOE signal line 11 in parallel, and a second delay circuit 54 includes a plurality of delaying parts D25~D28 connected to a second SOE signal line 13 in parallel, whereby the detailed explanation for the same parts will be omitted.

In the first delay circuit 52 of FIG. 8, the plurality of delaying parts D21~D24 connected to the first SOE signal line 11 in parallel are provided with time constants R21C21~R24C24 which are set with different values at uniform interval of difference, preferably. In the second delay circuit 54 of FIG. 8, the plurality of delaying parts D25~D28 connected to the second SOE signal line 13 in parallel are provided with time constants R25C25~R28C28 which are set with different values at uniform interval of difference, preferably.

In this case, the time constants R21C21~R28C28 of the delaying parts D21~D28 may be randomly increased or decreased in value. In order to minimize the deviation in data output timing between the adjacent data ICs, it is preferable to successively increase or decrease the time constants R21C21~R28C28. Also, the time constants R21C21~R24C24 of the delaying parts D21~D24 included in the first delay circuit 52 may be symmetric or asymmetric to the time constants R25C25~R28C28 of the delaying parts D25~D28 included in the second delay circuit 54.

The delaying parts D21~D24 included in the first delay circuit 52 respectively supply SOE1 to SOE4 signals, whose rising time and falling time are delayed by its own time constant RC, to the first to fourth data ICs D-IC1~D-IC4 of the first data driver 32. Also, the delaying parts D25~D28 included in the second delay circuit 54 respectively supply SOE5 to SOE8 signals, whose rising time and falling time are delayed by its own time constant RC, to the fifth to eighth data ICs D-IC5~D-IC8 of the second data driver 34.

In response to the respective falling times of the SOE1 to SOE8 signals provided with the different delay times, the output timing of data ICs D-IC1~D-IC8 is dispersed. The data output timing of the data ICs D-IC1~D-IC4 included in the first data driver 32 may be symmetric to the data output timing of the data ICs D-IC5~D-IC8 included in the second data driver 34, or may be asymmetric to the data output timing of the data ICs D-IC5~D-IC8 included in the second data driver 34 according to the alternate or sequential order. Thus, the peak of output current of first and second data drivers 32 and 34 is dispersed and decreased. Accordingly, it is possible to decrease EMI noise and power consumption and to prevent malfunctioning of the liquid crystal panel.

Figure 9:
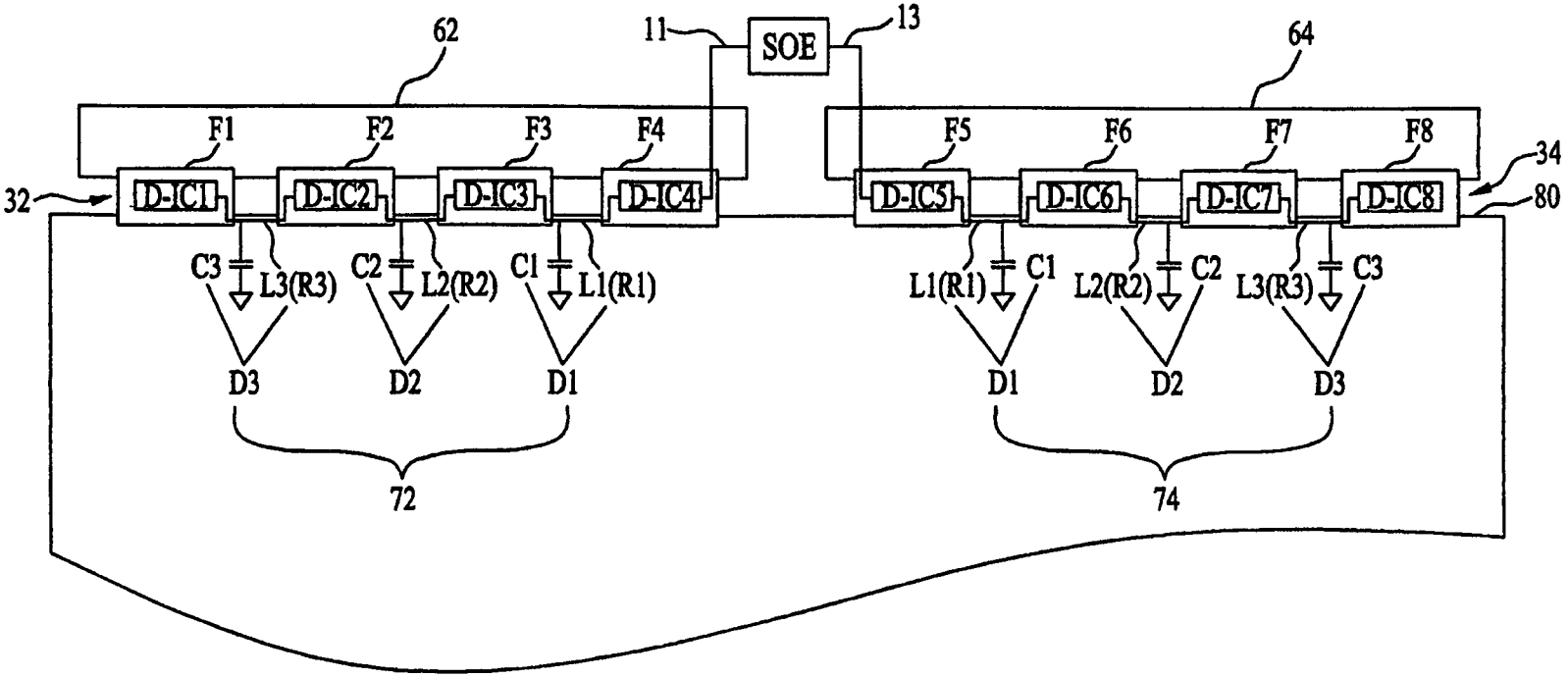
FIG. 9 is a block diagram schematically illustrating a data driving apparatus of a liquid crystal display device according to the fifth embodiment of the present disclosure.

FIG. 9 is a block diagram schematically illustrating a data driving apparatus of a liquid crystal display device according to the fifth embodiment of the present disclosure.

As shown in FIG. 9, the data driving apparatus is comprised of data ICs D-IC1~D-IC4 of a first data driver 32 mounted respectively on a plurality of circuit films F1~F4 and connected between a first PCB 62 and a liquid crystal panel 80; data ICs D-IC5~D-IC8 of a second data driver 34 mounted respectively on a plurality of circuit films F5 F8 and connected between a second PCB 64 and the liquid crystal panel 80; and first and second delay circuits 72 and 74, formed in the liquid crystal panel 80, for delaying an SOE signal. The circuit films F1~F8 may be formed of Tape Carrier Packages (hereinafter, referred to as "TCP") or Chip On Films.

The first delay circuit 72 includes a plurality of delaying parts D1~D3 connected to a first SOE signal line 11 in series and formed in a lower substrate of the liquid crystal panel 80. For this, the first SOE signal line 11 passes through the data ICs D-IC4~D-IC1 on the lower substrate of the liquid crystal panel 80. A resistance in each of the delaying parts D1~D3 is determined based on each line resistance R1~R3 of Line On Glass (hereinafter, referred to as "LOG") L1~L3, that is, a line connected to the first SOE signal line 11 in series and formed on the lower substrate of the liquid crystal panel 80. Each of capacitors C1~C3 may be formed by overlapping each LOG LI L3 with the other LOG with an insulating film interposed therebetween, or may be formed in each of the data ICs D-IC3~D-IC1. The line resistances R1~R3 may be the same, and the capacitors C1~C3 may be the same, whereby time constants D1~D3 of the delaying parts may be set with the same value.

The second delay circuit 74 is identical in structure to the first delay circuit 72. That is, the second delay circuit 74 includes a plurality of delaying parts D1~D3 connected to a second SOE signal line 13 in series and formed between each of the data ICs D-IC5~D-IC8 of the second data driver 34.

Since the first and second delay circuits 72 and 74 are respectively connected to the first and second SOE signal lines 11 and 13 in series, the delay time of SOE signal is increased in proportion to the number of delaying parts D through which the SOE signal passes.

For example, in case of the first data driver 32, the SOE signal is supplied to the fourth data IC D-IC4 which is nearest to an input terminal of SOE signal, without passing through the delay circuit 72. Then, the third data IC D-IC3 is supplied with the SOE signal which is delayed by the time constant R1C1 of the first delaying part D1 as passing through the fourth data IC D-IC4 and the first delaying part D1 of the liquid crystal panel 80. The second data IC D-IC2 is supplied with the SOE signal which is delayed by the total of time constants R1C1+R2C2 of first and second delaying parts D1, D2 as passing through the fourth and third data ICs D-IC4 and D-IC3 and the first and second delaying parts D1 and D2 of the liquid crystal panel 80. The first data IC D-IC1 is supplied with the SOE signal which is delayed by the total of time constants R1C1+R2C2+R3C3 of first to third delaying parts D1~D3 as passing through the fourth to second data ICs D-IC4~D-IC2 and the first to third delaying parts D1~D3 of the liquid crystal panel 80.

The data ICs D-IC5~D-IC8 of the second data driver 34 are respectively supplied with the SOE signals having the different delay times by the second delay circuit 74 being symmetric to the first delay circuit 72.

Accordingly, the data ICs D-IC1~D-IC4 of the first data driver 32 output the data at the different output timings in response to the different SOE delay times. Also, the data ICs D-IC5~D-IC8 of the second data driver 34 output the data at the different output timings in response to the different SOE delay times. As a result, the data output timing is dispersed in the first and second data drivers 32 and 34, whereby the peak of output current is also dispersed and decreased, thereby decreasing the EMI noise and power consumption and preventing the malfunctioning of the liquid crystal panel.

As mentioned above, the apparatus and method of driving data of the liquid crystal display device according to the present invention has the following advantages.

The apparatus and method of driving data of the liquid crystal display device according to the present invention can disperse the peak current of data driver by dispersing the output timing of data signal with the delay of SOE signal using the serial or parallel delay circuit. Accordingly, it is possible to decrease the EMI noise and power consumption and to prevent the malfunctioning of the gate line and gate driver.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A data driving apparatus of liquid crystal display device comprising:

a timing controller that supplies a reference source output enable signal;

a delay circuit that delays the reference source output enable signal and supplies a plurality of source output enable signals with respective delay times; and a data driver comprising a first data driver and a second data driver, each respectively including a plurality of data ICs to divide and drive data lines of a liquid crystal panel into a plurality of data blocks, which disperses data output timing of the plurality of data ICs in response to the plurality of source output enable signals, wherein:

the delay circuit comprises a first plurality of delaying parts-configured to delay the reference source output enable signal supplied to the data ICs of the first data driver by respective delay times, the delay circuit further comprises a second plurality of delaying parts configured to delay the reference source output enable signal supplied to the data ICs of the second data driver by said respective delay times, the reference source output enable signal and the plurality of source output enable signals have respective rising times and respective falling times such that a peak current of the data driver is dispersed and decreased corresponding to the respective delay times of the plurality of source output enable signals, the delaying parts are connected to a supply line which supplies the reference source output enable signal from the timing controller to the data ICs, the delaying parts directly delay the reference source output enable signal from the timing controller with the respective delay times to control a data output period of each of the plurality of data ICs by being connected to the supply line of the reference source output enable signal, and further output the delayed reference source output enable signals with the respective delay times as the plurality of source output enable signals, and each of the source output enable signals controls the data output period of each of the plurality of data ICs.

2. The apparatus of claim 1, wherein the delaying parts are provided with time constants set with the same delay time value.

3. The apparatus of claim 1, wherein the plurality of data ICs are supplied with the plurality of output enable signals in a sequential order where the delay time is increased gradually as becoming more distant from the timing controller.

4. The apparatus of claim 1, wherein the delaying parts delay the reference source output enable signal with respective delay times.

5. The apparatus of claim 4, wherein each of the delaying parts comprises resistive (R) and capacitive (C) components, and at least one of the R and C components is differently set in the respective delaying parts so as to configure the plurality of delaying parts with the respective delay times.

6. The apparatus of claim 4, wherein the plurality of data ICs are supplied with the plurality of source output enable signals having the respective delay times which are sequentially increased or decreased.

7. The apparatus of claim 1, wherein the delay circuit is mounted on a PCB substrate connected between the timing controller and the data driver, or is formed in each of the data ICs.

8. The apparatus of claim 7, wherein each of the delaying parts comprises resistive (R) and capacitive (C) components, and at least one of the R and C components of the respective delaying parts is mounted on the PCB substrate connected between the timing controller and the data driver, and the other component is formed in each of the data ICs.

9. The apparatus of claim 1, wherein each of the delaying parts comprises resistive (R) and capacitive (C) components, at least one of the R and C components of the respective delaying parts is formed in the liquid crystal device.

10. The apparatus of claim 9, wherein the C component of the delaying parts is formed in each of the corresponding data ICs.

11. The apparatus of claim 1, wherein the first plurality of delaying parts delays the reference source output enable signal supplied through a first supply line and the second plurality of delaying parts delays the reference source output enable signal supplied through a second supply line.

12. The apparatus of claim 11, wherein the delaying parts of first plurality are connected to the first supply line in parallel, and the delaying parts of second plurality are connected to the second supply line in parallel.

13. A data driving apparatus of liquid crystal display device comprising:

a timing controller that generates a reference source output enable signal and supplies the generated reference source output enable signal to first and second supply lines;

a first data driver, including a plurality of data ICs, for division-driving data lines included in a first region of a liquid crystal panel;

a second data driver, including a plurality of data ICs, for division-driving data lines included in a second region of the liquid crystal panel;

a first PCB substrate connected between the timing controller and the first data driver;

a second PCB substrate connected between the timing controller and the second data driver;

a first delay circuit, mounted on the first PCB substrate, for dispersing data output timing of the first data driver by delaying the reference source output enable signal supplied from the first supply line; and a second delay circuit, mounted on the second PCB substrate, for dispersing data output timing of the second data driver by delaying the reference source output enable signal supplied from the second supply line, wherein:

the first and second delay circuits are configured to output a plurality of source output enable signals based on the reference source output enable signal delayed by respective delay times;

the reference source output enable signal and the plurality of source output enable signals have different rising times and different falling times such that peak currents of the first and second data driver are dispersed and decreased corresponding to different delay times of the reference source output enable signal;

the first delay circuit includes a plurality of delaying parts connected to the first supply line, the first delay circuit is configured to delay the reference source output enable signal by respective delay times;

the second delay circuit includes a plurality of delaying parts connected to the second supply line, the second delay circuit is configured to delay the reference source output enable signal by said respective delay times of the first delay circuit; and the plurality of delaying parts of the first delay circuit and the second delay circuit directly delay the reference source output enable signal from the timing controller with the respective delay times to control a data output period of each of the plurality of data ICs.

14. The apparatus of claim 13, wherein each of the plurality of delaying parts of the first delay circuit has a different time constant;

and each of the plurality of delaying parts of the second delay circuit has a different time constant that matches the time constant of corresponding delaying part of the first delay circuit.

15. The apparatus of claim 14, wherein the data output timing of the respective data ICs of the first data driver is dispersed at a constant time difference, and the data output timing of the respective data ICs of the second data driver is dispersed at a constant time difference.

16. The apparatus of claim 15, wherein the time difference of data output timing dispersed in the first data driver is symmetric or asymmetric to the time difference of data output timing dispersed in the second data driver.

17. The apparatus of claim 1, wherein the reference source output enable signal and the plurality of source output enable signals have the same rising start time and the same falling start time.

18. The apparatus of claim 1, wherein each of the plurality of data ICs parallel-latches sequentially-latched data to convert analog data signals at any one time of the rising time and the falling time of the corresponding source output enable signal, and outputs the analog data signals to the corresponding data lines at the other time of the rising time and the falling time of the corresponding source output enable signal.

19. The apparatus of claim 13, wherein the reference source output enable signal and the plurality of source output enable signals have the same rising start time and the same falling start time.

20. The apparatus of claim 13, wherein each of the plurality of data ICs parallel-latches sequentially-latched data to convert analog data signals at any one time of the rising time and the falling time of the corresponding source output enable signal, and outputs the analog data signals to the corresponding data lines at the other time of the rising time and the falling time of the corresponding source output enable signal.

21. The apparatus of claim 11, wherein the delaying parts of the first plurality are connected to the first supply line in series, and the delaying parts of the second plurality are connected to the second supply line in series.

22. The apparatus of claim 1, wherein the first plurality of delaying parts and the second plurality of delaying parts have an equal number of delaying parts arranged sequentially, and a first delaying part in a sequence of the first plurality corresponds to a first delaying part in a sequence of the second plurality.

23. The apparatus of claim 1, wherein the first plurality of delaying parts and the second plurality of delaying parts have an equal number of delaying parts arranged sequentially, and a first delaying part in a sequence of the first plurality corresponds to a last delaying part in a sequence of the second plurality.

24. The apparatus of claim 14, wherein the delaying parts of the first delay circuit connect to the first signal line in parallel and the delaying parts of the second delay circuit connect to the second signal line in parallel.

25. The apparatus of claim 14, wherein the delaying parts of the first delay circuit connect to the first signal line in series and the delaying parts of the second delay circuit connect to the second signal line in series.

26. The apparatus of claim 1, where a delaying part of the delaying parts has an incremental delay of between 10 and 500 ns.

* * * * *